United States Patent [19]

Wolff

[11] 4,418,805

[45] Dec. 6, 1983

[54] HINGE MEANS AND LUGGAGE COMBINED THEREWITH

[76] Inventor: Robert C. Wolff, 955 Crystal Ct., New Orleans, La. 70124

[21] Appl. No.: 281,591

[22] Filed: Jul. 9, 1981

[51] Int. Cl.[3] ..... A45C 3/00; E05D 1/04

[52] U.S. Cl. ..... 206/279; 190/100; 16/359; 190/107; 190/901

[58] Field of Search ..... 190/41 R, 41 B, 41 Z, 190/43, 48, 49; 220/337, 331; 16/348, 357, 358, 359, DIG. 29

[56] References Cited

U.S. PATENT DOCUMENTS

| | | | |
|---|---|---|---|
| 814,354 | 3/1906 | Carter | 16/348 |
| 1,730,058 | 10/1929 | Butterick | 190/41 B |
| 1,823,403 | 9/1931 | Krueger | 190/41 Z |
| 2,296,080 | 9/1942 | Arrowood | 190/43 |
| 2,497,243 | 2/1950 | Turner | 16/359 |
| 3,065,498 | 11/1962 | Johnson | 190/359 |

*Primary Examiner*—William Price
*Assistant Examiner*—Sue A. Weaver
*Attorney, Agent, or Firm*—Charles C. Garvey

[57] ABSTRACT

The present invention provides unique hinge means comprising three components, two of which are wedge shaped members or segments which slidably pivot relative to each other about a central pivot point and the third being a base bracket pivotably attached to the center wedge whereby the two wedge members fan open relative to the base bracket in operational sequence.

The present hinge finds particular application for use in a solid rigid suitcase and which is adapted for retaining garments in a full length arrangement. The present suitcase comprises two halves operably connected along their bottom portions by opposing pairs of expanding hinges positioned at each end. Each hinge in turn further comprises the structure recited above whereby the two wedge shaped members slidably pivot relative to each other about a central pivot point defined by a longitudinal hinge connecting one suitcase half to a butt plate portion located along the bottom of the suitcase which in turn is similarly hinged on its opposite side to the other remaining suitcase half such that when the suitcase is open in an extended position there is no compartment wall defined between the adjoining bottom portions of the suitcase halves.

12 Claims, 17 Drawing Figures

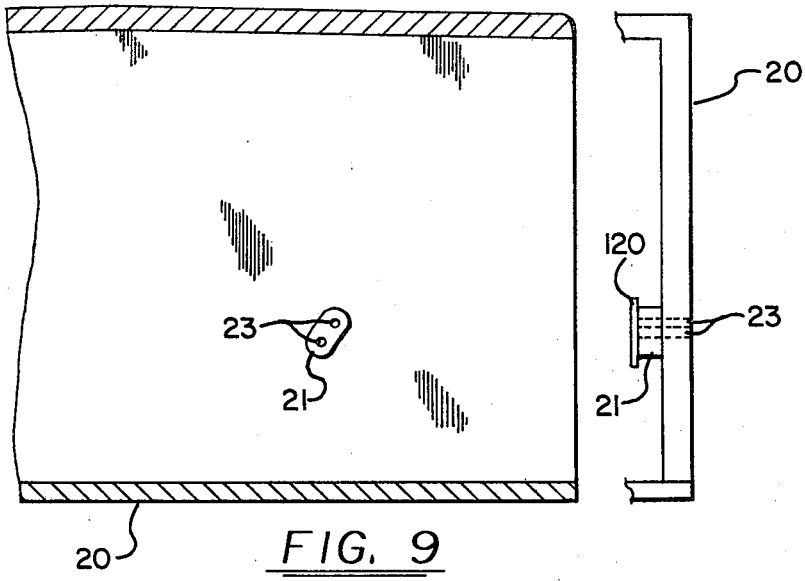
FIG. 9
FIG. 10
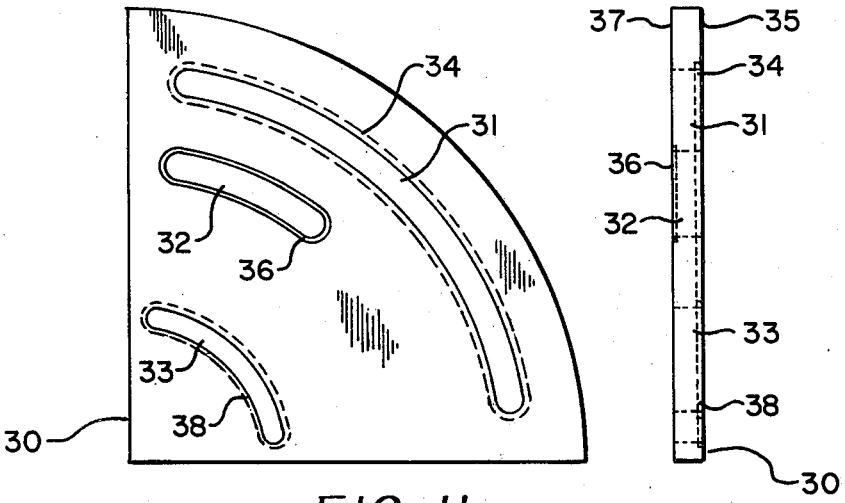
FIG. 11
FIG. 12
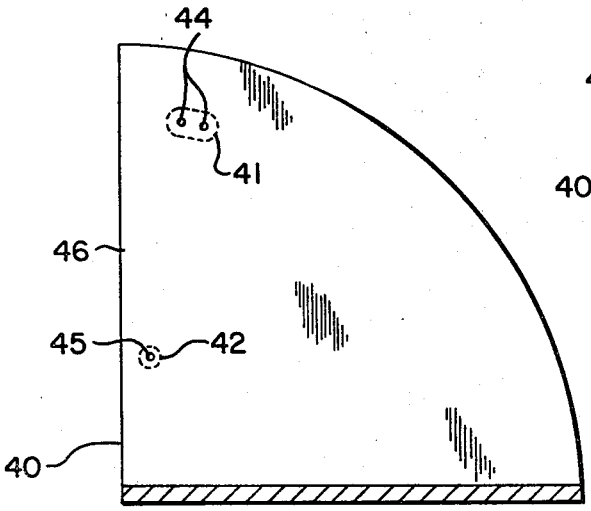
FIG. 13
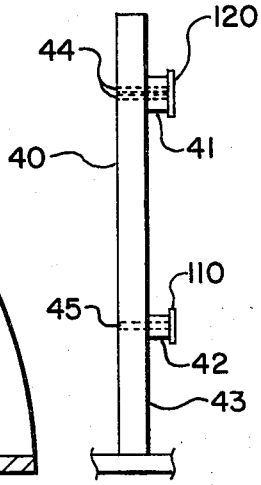
FIG. 14
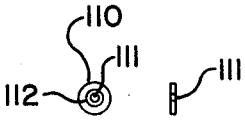
FIG. 15
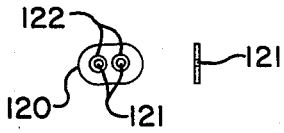
FIG. 16

HINGE MEANS AND LUGGAGE COMBINED THEREWITH

BACKGROUND OF THE INVENTION

The present invention pertains to a hinge assembly finding diversified application in the hinge arts. More particularly, the present invention provides a hinge assembly comprising three components.

The present invention also pertains to suitcase or luggage devices. More specifically, the present invention is concerned with a rigid type of suitcase which is particularly adapted to retain full length garments.

There are many applications which require a hinge design that not only provides overall strength, but additionally allows full opening past 90° while still retaining its overall strength. The present hinge design not only offers these advantages and features over prior art hinge designs, but additionally provides a hinge which is self-sealing against dust. The present hinge finds particular application in the luggage arts for the reasons brought out below.

Over the years, suitcase or luggage devices have been particularly adapted for retaining full length garments, especially women's apparel, such that the garments need not be folded. Such luggage means have invariably been made of a pliable material which in effect resembles or constitutes a garment bag suitably provided with a zipper. Such garment luggage is also generally provided with a hanger bracket therein whereby clothes can be placed upon special hangers provided in conjunction therewith and securely attached within the bag, which after being zippered closed is then folded over to thus resemble a suitcase, generally being provided with a handle on the outside portion of the seam or fold for carrying the garment bag.

Needless to say, such garment bags suffer many disadvantages. For example, being soft and pliable, they are quite easily crushed. Moreover, being provided with zippers, they are not as moisture and soil proof as conventional rigid type of luggage. In addition, being pliable, that is constructed of a resilient pliable materials, they are quite often torn or damaged when subjected to the normal amount of abusive handling in transit.

Another very distinctive disadvantage of such garment bags is the fact that even though certain luggage manufacturers produce the bags in similar colors and design features as that particular manufacturer's line of rigid luggage, nevertheless they invariably do not appear to be of similar origin, viz. they simply do not match the rest of the rigid type of luggage design with which they have attempted to be mated.

Among the many advantages and features of the present invention is the fact that a complete set of matched rigid structure luggage can be provided comprising the present rigid garment suitcase of the present invention. Additionally, the instant invention provides a full length garment storage rigid structured suitcase which also overcomes all of the other above described disadvantages of full length garment bag types of luggage. The above together with other features and advantages of the instant invention will be apparent to one skilled in the art in light of the details of construction and operation of the present suitcase as shown in the drawings and described in the ensuing detailed disclosure of its preferred embodiments which are particularly pointed out in the appended claims.

DESCRIPTION OF THE DRAWINGS

For a better understanding of the nature and objects of the invention, reference should be had to the following drawings, taken in conjunction with the detailed description thereof. In the drawings, synonymous reference numerals are employed throughout in the various views to refer to identical components.

FIG. 9 of the drawings represents a partial view of the inner most rigid compartment portion of the present hinge.

FIG. 10 of the drawings represents a right hand side elevation view of the compartment portion of FIG. 9.

FIG. 11 of the drawings illustrates a side elevation view of the intermediate or center follower or quadrant of the present hinge.

FIG. 12 of the drawings represents a right hand side elevational view of FIG. 11.

FIG. 13 of the drawings represents a side elevational view of the outer follower or quadrant of the present hinge.

FIG. 14 of the drawings represents a right hand side elevational view of the quadrant shown in FIG. 13.

FIG. 15 of the drawings illustrates on the left a plan view of the slide stop or protrusion point to protrusion cap or retainer means, and on the right a side elevation view thereof.

FIG. 16 of the drawings illustrates on the left a plan view of the protrusion 21 cap or retainer, and on the right a side elevation view thereof.

DESCRIPTION OF THE PREFERRED EMBODIMENT(S)

Figures 1, 2, 3:
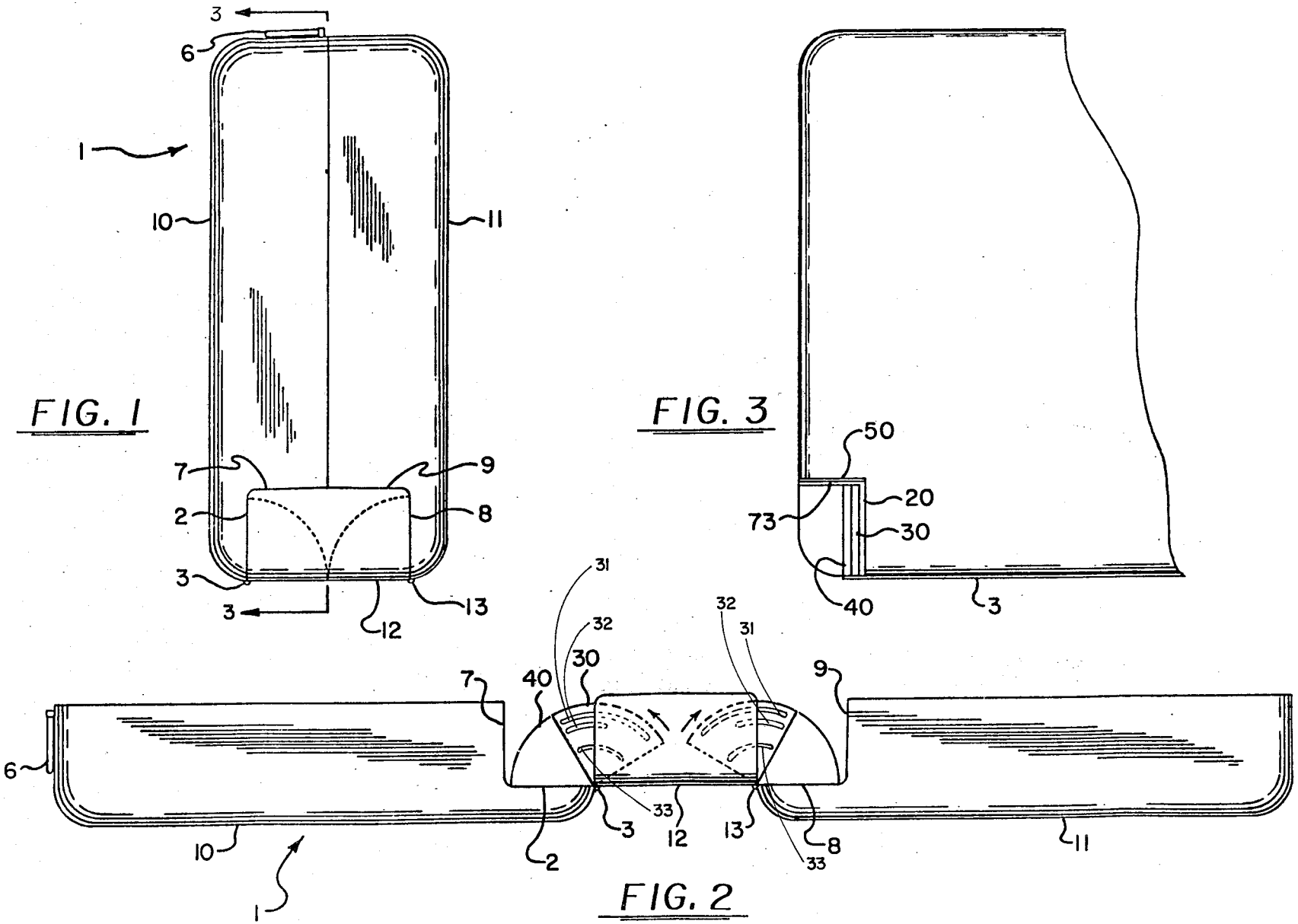
FIG. 1 in the drawings represents a side elevational view of the present suitcase means.
FIG. 2 in the drawings illustrates a side view of the present suitcase means when fully opened in an extended position, e.g. when hanging with garments located therein or in position for filling or emptying.
FIG. 3 represents a sectional view taken along the line 3—3 of FIG. 1 of the drawings.

Referring to FIGS. 1 and 2 of the drawings, the present suitcase or luggage means 1 comprises the essentially identical halves 10 and 11. The members 10 and 11 are operably attached to each other by virtue of the butt plate or bottom portion 12. The latter member is shown in an isolated isometric view in FIG. 6 which is described in detail hereinafter. The bottom portion 12 is operably attached to the respective halves 10 and 11 by virtue of the conventional elongated hinge means 3 and 13, respectively. As shown in FIG. 3, the hinges 3 and 13 extend longitudinally along the bottom edges of the halves 10 and 11 in their mating relationship with the longitudinal edges of the butt plate member 12.

Each of the suitcase halves 10 and 11 are notched out at their bottom corners to receive the retro fit hinge assembly of the present invention. That is, referring to the half 10 as shown in FIGS. 1 thru 4 of the drawings, each bottom end corner thereof is cut along the surfaces 2 and 7 to define an L-shaped cutout portion as shown. The L-shaped compartment member 50 is fitted within the cutout corner, see FIG. 4 in particular. In a similar fashion, the half 11 is provided with the L-shaped cutout portion defined by the lines 8 and 9, adjacent to which the L-shaped compartment member 51 is rigidly fixed.

Figure 6:
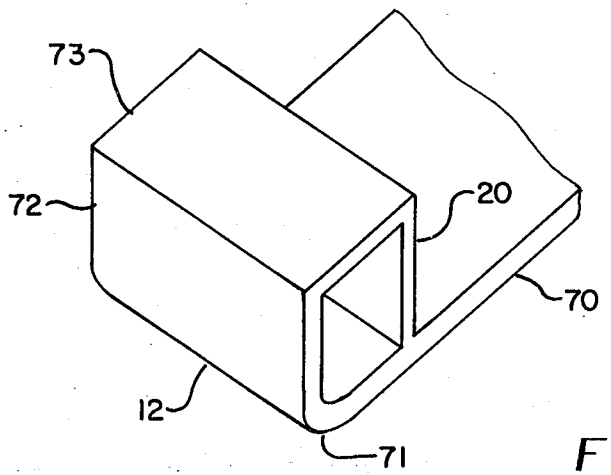
FIG. 6 of the drawings illustrates an isometric view of the bottom butt plate portion of the hinge assembly shown from an end view in FIGS. 1 and 2 of the drawings.
Figure 17:
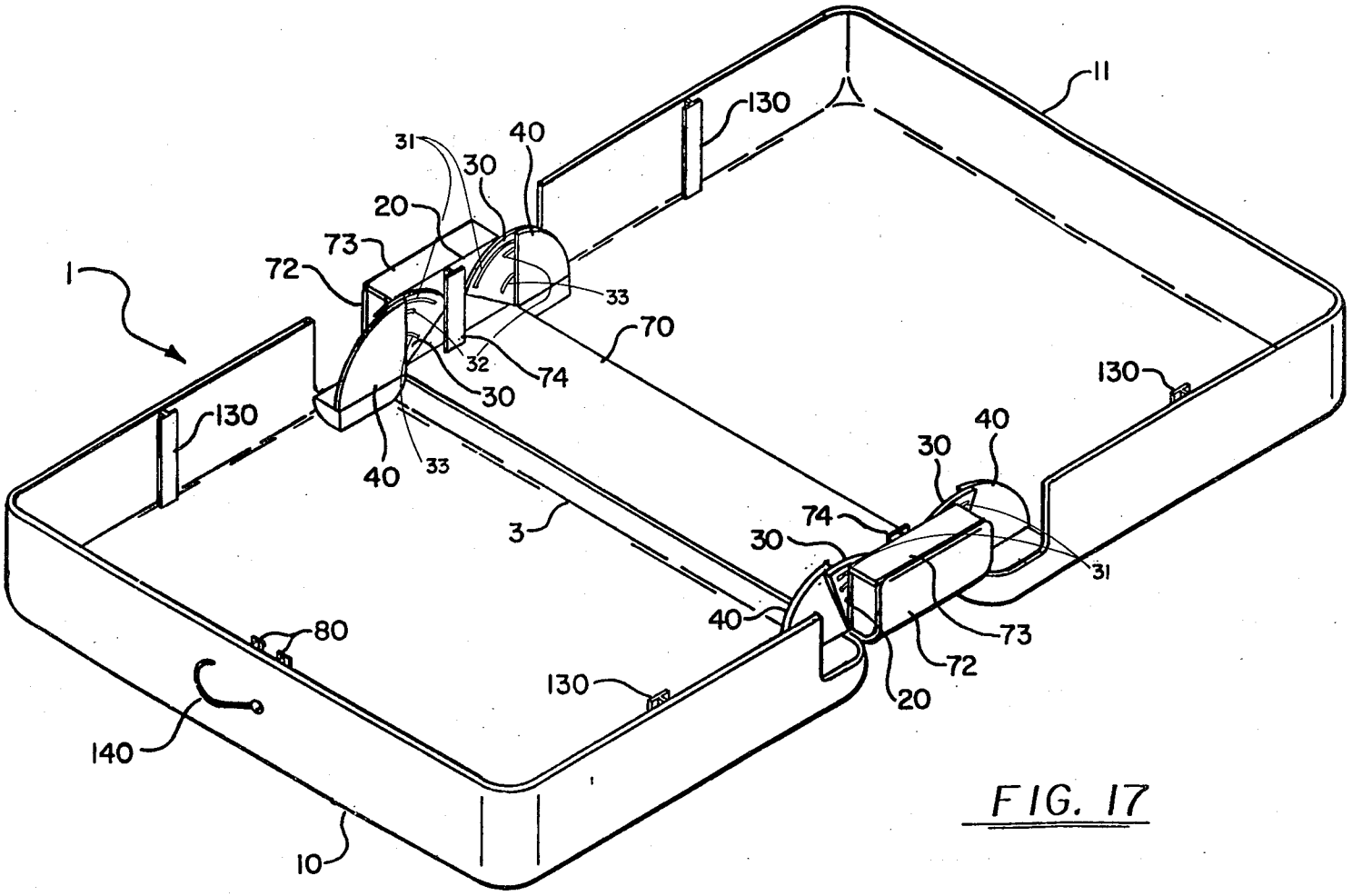
FIG. 17 represents an isometric view of one manner of incorporating the present hinge design in a suitcase.

As shown in greater detail in FIG. 6 of the drawings, the bottom most portion 70 which extends lengthwise underneath the present suitcase design. At its end portion 71, it is rounded to conform with the contour of the rounded edges of the suitcase halves 10 and 11 and extends upward to define the vertical endplate portion 72 which nestles within the mating L-shaped cutout portions of each respective suitcase half 10 and 11. The bottom plate 12 is further provided with the top plate portion 73 which together with the rear plate vertical portion 20 defines a cubicle or compartment which in the present retro fit hinge means is confined or nestles when the present suitcase is in a closed condition. Conversely, the components of the present retro fit hinge can be operably positioned on the opposite side of the vertical portion 20 as shown in FIG. 17 of the drawings. The rear plate portion 20 in effect also comprises a part of the present retro fit hinge assembly as described in greater detail below with regard to FIGS. 9 thru 14 of the drawings. Of course, the bottom plate 12 can be fabricated of different components suitably rigidly affixed to each other, or formed in one solid member as shown.

The retro fit hinge of the present invention comprises the three distinct portions as especially shown in FIGS. 9 thru 14 of the drawings. FIG. 9 illustrates the stationary portion of the present hinge and in effect comprises the back wall portion 20 of the bottom plate member 12. FIG. 9 illustrates only one-half of the plate 20 which is shown in its extended structure in FIG. 8. The stationary hinge plate member 20 is provided with the slide stops or protrusions 21 and 22, see FIG. 8 also, which are slightly curved to slidably fit within the arcuate slot 32 of the intermediate hinge quadrant 30 as shown in FIG. 11. As shown in FIG. 9, those members are rigidly affixed to the plate 20 by suitable means, e.g., the pins 23 which affix the member 21 thereto, as well as the elongated retaining means 120. The latter fits within the rim 36 of the groove 32 wherein the elongated extension 21 is slidably fitted. In such fashion, the mid-segment 30 is pivotably affixed to the back plate or stationary segment 20 in a sliding relationship.

Referring to FIGS. 11 and 12, the intermediate wedge shaped member or segment 30 comprises the wedge or pie shaped member provided with the arcuate slots or grooves 31, 32, and 33. The groove 31 extends along the radial arcuate path over essentially the whole circumferential distance adjacent to its peripheral outer edge. The opposite side of the groove 31 is provided with the indented grooved rim 34 wherein the retaining cap member 120 as shown in FIGS. 14 and 16 fits or is nestled. The retaining cap 120 holds the hinge segment 30 in juxtaposition to the outer segment 40 whereby the members 30 and 40 are allowed to pivot relative to each other in a sliding relationship. The radii of the arcuate slots 32, 33, 34 is measured from the central pivot point 150.

Referring also to FIGS. 13 and 14, the members 30 and 40 are further retained together in a sliding relationship by virtue of the round extension 42 which is rigidly affixed to the stationary segment 40 by virtue of the retaining pin or rivet 45. Positioned on the outer side of the extension 42 is the circular retaining plate means 110 which operably fits within and slides within the groove 38 of the arcuate slot 33 of the segment member 30, the extension 42 being of a diameter so as to slidably fit therein in a similar fashion as the elongated extension 21 fits within the groove 31.

Figure 4:
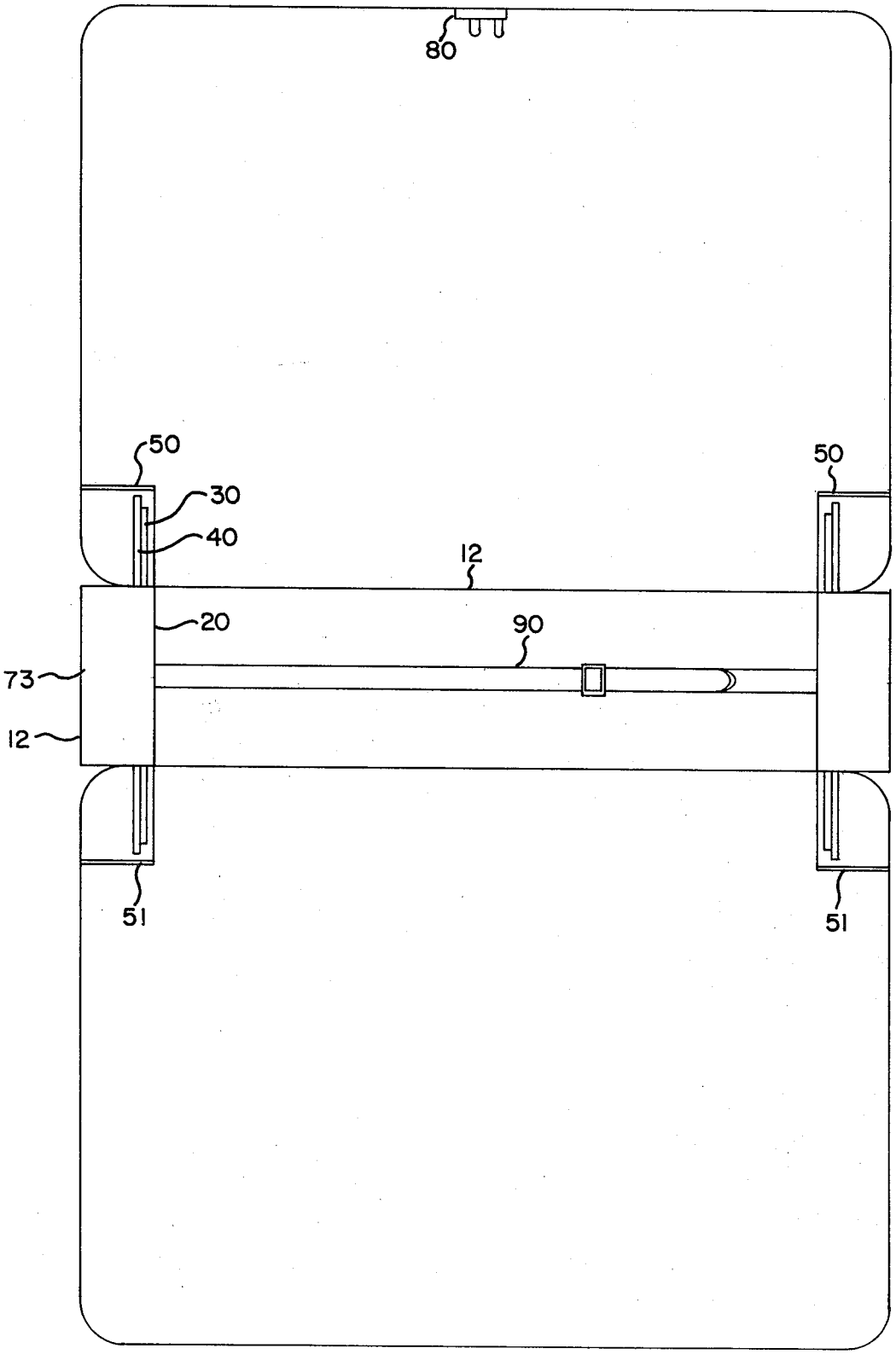
FIG. 4 in the drawings shows a top plan view of the view shown in FIG. 2 in the drawings.
Figure 5:
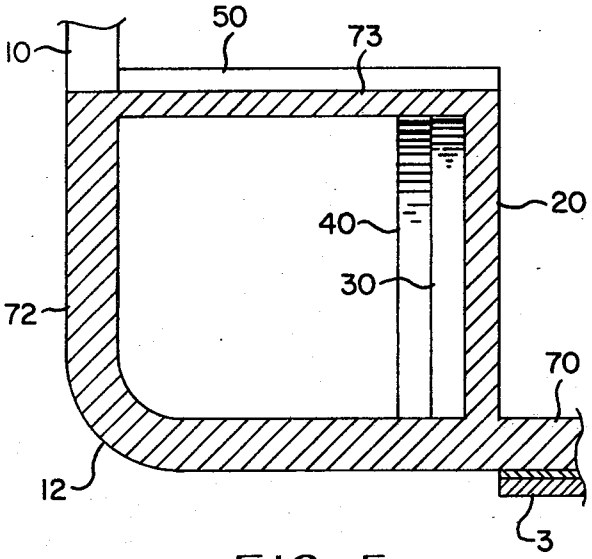
FIG. 5 in the drawings illustrates an isolated sectional view of the hinge portion shown in FIG. 3 of the drawings taken along the same sectional line.

The middle segment 30 is operably attached to the stationary segment or component 20 in the manner discussed above and by virtue of such interconnecting features, the entire hinge assembly is thus sandwiched together in a sliding relationship as shown further in the details of FIGS. 3 and 4 of the drawings. FIG. 5 is an isolated cross-sectional view also showing this relationship.

Figure 8:
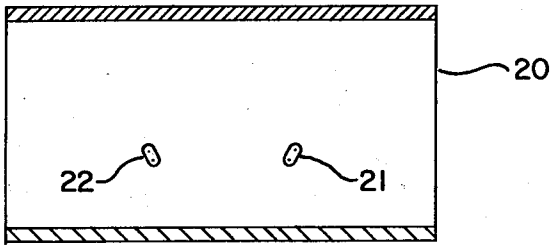
FIG. 8 of the drawings illustrates the isolated view of the inner most compartment wall forming a part of the present retro fit hinge of the present invention, part of which is further illustrated in FIGS. 9 and 10.
Figure 7:
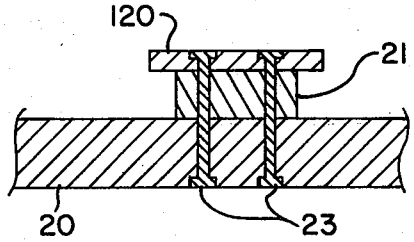
FIG. 7 of the drawings depicts a partial cross-sectional view of the slide stop or protrusion 21 shown in FIG. 9 of the drawings illustrating one method of attachment.

FIG. 7 represents an isolated cross-sectional view of one of the elongated extensions 21 or 22 as affixed to the stationary back plate member 20, see FIG. 8, or the member 41 forming a part of the outer segment 40. Referring specifically to FIGS. 9 and 10 of the drawings with regard to the elongated extension 21, the extension 21 is rigidly affixed to the stationary plate member 20 by virtue of the rivets 23 which further serve to retain the retaining plate means 120 thereto.

FIG. 17 of the drawings illustrates an isometric view of another way of employing the hinge of the present invention in its more preferred application, that is, as the hinge assembly in a full length garment rigid suitcase. However, the various hinge assemblies, totaling 4, are positioned on the exterior side of the stationary plate or segment 20. Specifically, referring also to FIG. 5 wherein the segments 30 and 40 are shown on the interior side, relative to the stationary segment 20. In the arrangement of FIG. 17, the vertically oriented shield members 74 are provided to prevent pinching of clothing placed in the suitcase by virtue of the segments 30 as they pivot in and out of position in the process of opening and closing the suitcase 1. Interior garment bracket attaching means 130 are provided along the inner sidewalls of each suitcase half. A hanging means 140 is provided for hanging the present suitcase means in an upright vertical position.

As shown in FIG. 4, the strap means 90 is provided for retaining clothing within the suitcase 1. Further, the hangar holder 80 is also provided wherein clothes hangars are retained during transport of the present suitcase, as well as when it is suspended in an opened vertical condition with the clothing still retained therein.

As can be appreciated from the various Figures of the drawings, specifically, FIG. 17, by virtue of the present rigid garment suitcase, clothing can be laid out therein as in the case of a conventional nonrigid plyable garment bag by virtue of the incorporation of the present hinge design whereby the center ridge as designed in a conventional suitcase is eliminated, that is, the butt plate 70 is substituted therefore. Further, by virtue of the hinge assemblies, the present suitcase when opened is prevented from extending past 180°, that is, the half 10 relative to the half 11 is prevented from opening more than 180°. Further, it is evident from FIG. 17 that the present hinge also provides considerable lateral strength to thereby produce a unitized structure. Further, it can be appreciated that when the suitcase is closed as shown in FIG. 1 of the drawings, the hinge design of the present invention provides a dustproof enclosure to thereby prevent dust and fumes from readily entering the suitcase.

It will be obvious to one skilled in the art that many different modifications can be made in the present design of hinge assembly, as well as the adaptation to its preferred application to use in providing a full length garment rigid suitcase without departing from its true scope and spirit. For example, the segments can vary slightly in design and shape without changing the basic concept of the present hinge. Moreover, the extensions that fit within the grooves of the segment can be fabricated as part of the respective base member, for example, by molding them integral therewith. Additionally, as brought out above, the hinge assembly itself can be located in various positions within the suitcase assembly. In light of the above, since many such modifications may be made in the embodiments as disclosed in detail herein in accordance with the descriptive requirements of the law, it is to be understood that the details of my inventive concept are to be interpreted as illustrative and not in a limited sense. Therefore, what I intend to encompass within the ambit of my invention is that as set forth and particularly pointed out in the appended claims.

I claim:

1. Retro fit hinge means comprising:

a. stationary inner segment means;

b. intermediate wedge shaped segment means slidably attached to said inner segment means;

c. outer segment means suitably attached to said intermediate wedge shaped segment means;

d. said intermediate segment is further defined as having arcuate slots provided therein;

e. said intermediate segment means is further defined as having a central pivot point about which said segments pivot wherein said arcuate slots can be located on said intermediate wedge based on their distance from central pivot point; and f. said inner and outer segment means are further defined as comprising extended portions adapted to fit within the arcuate slots of said intermediate segment means.

2. The retro fit hinge means of claim 1 further characterized in that:

said intermediate segment means is provided with three arcuate slots lying along paths of different radii;

said inner segment means is provided with an elongated extension adapted to slidably fit within the middle slot of said intermediate segment means; and said outer segment means is provided with two extensions adapted to slidably fit within the inner and outer slots of said intermediate segment means.

3. The retro fit hinge means of claim 2 further characterized in that:

said extensions provided on said inner and outer segments means are provided with retaining means for holding said segments together in a sliding relationship.

4. The retro fit hinge means of claim 2 further characterized in that:

the slots provided in said intermediate segment means are provided with indented grooved rims lying along the edges thereof on the side of said inner segment means opposite to the side from which a respective extension enters a respective slot; and said extensions are provided with retaining cap means rigidly affixed to the end thereof, which cap means are of a greater width than a respective slot wherein it slidably fits and is defined to slidably fit within the indented groove rim of that respective slot.

5. In a full length garment suitcase having garment containing halves which are operably connected to each other, the improvement which comprises:

providing butt plate portion operably connected to each half by retro fit hinge means comprising stationary inner segment means rigidly affixed to said butt plate portion; intermediate wedgeshaped segment means slidably attached to said inner segment means; and outer segment means slidably attached to said intermediate wedge shaped means, rigidly affixed to an adjoining suitcase half allowing action of said outer segment means relative to said inner segment means.

6. Rigid full length garment suitcase means comprising:

a. a first suitcase half;

b. a second suitcase half;

c. an extended butt plate member operably connected to said suitcase halves; and d. segmented hinge means at each end of said butt plate member comprising stationary inner segment means rigidly affixed to said butt plate member; intermediate wedge shaped means slidably attached to said inner segment means; outer segment means slidably attached to said intermediate wedge shaped segment means, rigidly affixed to an adjoining suitcase half allowing motion of said outer segment means relative to said inner segment means.

7. The rigid full length garment suitcase means of claim 6 further characterized in that:

said suitcase halves are operably connected to each other by four retro fit hinge means; and said butt plate member comprises an extended member with upraised end portions which form said inner segment means.

8. The rigid full length garment suitcase means of claim 7 further characterized in that:

said suitcase halves are cut out along their bottom inner corners to receive the upraised end portions of said butt plate member.

9. The rigid full length garment suitcase means of claim 8 further characterized in that:

said outer segment means are rigidly attached to said suitcase halves at each bottom inner corner.

10. The rigid full length garment suitcase means of claim 9 further characterized in that:

said butt plate member is further defined as comprising inner end compartments extending along its upraised end portions into which said retro fit hinges operably fit.

11. The rigid full length garment suitcase means of claim 9 further characterized in that:

said butt plate member is further defined as comprising:

inner end compartments extending along its upraised end portions;

an upstanding T-shaped channel member rigidly affixed to the inside of end compartments; and said retro fit hinge means are adapted to fit outside of the inner end compartments of said butt plate member wherein the exposed edges of said intermediate and outer segments are nestled within said T-shaped channel member.

12. The rigid full length garment suitcase means of claim 9 further characterized as comprising:

interior strap means extending crosswise along the suitcase center for retaining garments therein;

interior hangar retaining means positioned at one end of the present suitcase means for retaining garments on hangars therein;

interior garment bracket attaching means positioned along the inner side walls of each suitcase half; and hanging means for hanging the present suitcase means in an upright vertical position.

* * * * *